United States Patent [19]

Maurer

[11] Patent Number: 4,619,393

[45] Date of Patent: Oct. 28, 1986

[54] DRIVING APPARATUS WITH NAIL STRIP CUTTER

[75] Inventor: Werner Maurer, Nuertingen, Fed. Rep. of Germany

[73] Assignee: Karl M. Reich Maschinenfabrik GmbH, Nuertingen, Fed. Rep. of Germany

[21] Appl. No.: 744,124

[22] Filed: Jun. 12, 1985

[30] Foreign Application Priority Data

Jun. 27, 1984 [DE] Fed. Rep. of Germany ..... 3423578

[51] Int. Cl.[4] ..... B25C 7/00; B25F 7/13

[52] U.S. Cl. ..... 227/136; 227/135; 227/137

[58] Field of Search ..... 227/135–137, 227/112

[56] References Cited

U.S. PATENT DOCUMENTS 1,162,678 11/1915 Boden ..... 227/136 X
3,099,837 8/1963 Heilman et al. ..... 227/112
3,661,313 5/1972 Pomernacki et al. ..... 227/136
4,313,552 2/1982 Maurer ..... 227/112 X
4,417,682 11/1983 Furutsu ..... 227/136 X

FOREIGN PATENT DOCUMENTS 1961114 8/1971 Fed. Rep. of Germany ..... 227/136
1389955 4/1975 United Kingdom ..... 227/136

*Primary Examiner*—Robert L. Spruill
*Assistant Examiner*—Taylor J. Ross
*Attorney, Agent, or Firm*—W. G. Fasse; D. H. Kane, Jr.

[57] ABSTRACT

A driving apparatus for fasteners, which receives the fasteners, such as nails, pins, or screws attached to a supply belt, has a cutter for cutting off sections of the supply belt as the latter comes out empty of a belt guide channel in which the fasteners are removed, one by one, from the supply belt. Thus, the empty supply belt can be easily removed and prevented from hindering the operation of the driving apparatus. The cutter may be operated manually or by pressure applied by a piston cylinder.

4 Claims, 3 Drawing Figures

DRIVING APPARATUS WITH NAIL STRIP CUTTER

FIELD OF THE INVENTION

The invention relates to a fastener driving apparatus. The fasteners, such as nails, pins, screws and the like are supplied into the apparatus with the aid of at least one fastener supply belt which may have a substantial length, the empty portion of which emerges from the fastener driving apparatus.

DESCRIPTION OF THE PRIOR ART

Such driving apparatus has a cylinder foot forming part of the housing and defining a fastener discharge channel in which a power operating driver rod is supported for a back and forth displacement. The fastener supply belt is usually held in a magazine which is secured to the housing of the driving apparatus so that the belt may travel through a belt entry into a belt guide channel and out again through a belt exit.

Such known fastener driving devices drive fastener means of different types and these fasteners, such as nails, pins, screws and so forth, are held in place by at least one fastener supply belt which is rolled up in spiral shape to fit into a drum type magazine connected to the discharge channel in the cylinder foot of the apparatus for supplying the fasteners into the discharge channel.

The driving movement of the driver rod removes one fastener at a time from the fastener supply belt and the empty portion of the fastener supply belt moves out of the cylinder foot provided with a belt exit for this purpose. When the empty portion of the supply belt reaches a certain length, it has a tendency to interfere with the operation and handling of the driving apparatus. Thus, it is known to provide the fastener supply belt with strength reducing indentations or the like at spaced intervals so that these empty belt portions can break off at these locations as the belt emerges from the belt exit.

However, the reduced strength locations along the belt do not have the exactly same reduced strength due to manufacturing reasons so that the proper breaking off of empty belt portions is not always assured. Additionally, these reduced strength locations along the supply belt have a tendency to break easily when the belt is still filled with fasteners which is undesirable because it may cause jamming of the driving apparatus.

OBJECTS OF THE INVENTION

In view of the foregoing it is the aim of the invention to achieve the following objects singly or in combination:

to avoid the difficulties of the prior art by assuring a positive removal of the empty portions of the fastener supply belt emerging from the apparatus; and to provide a chopping knife which is so arranged that it will positively chop off any desired portion of the empty fastener supply belt so that locations of reduced strength along the supply belt are no longer necessary.

SUMMARY OF THE INVENTION

A driving apparatus of the type described above is equipped according to the invention with a chopping knife mechanism located near the belt exit for the supply belt so that operation of the chopping off knife will cut off any desired length of the empty belt. Preferably, the chopping off knife is arranged adjacent to the cylinder foot of the apparatus and can either be operated manually or by a power drive such as a pneumatic power drive. In any event, the empty portions of the fastener supply belt can be quickly severed without the need for any reduced strength locations along the belt. Thus, the drawbacks encountered with such reduced strength locations have been avoided and the feeding of the supply belt into and through the apparatus as well as the operation of the apparatus can now take place free of trouble.

If the knife is operated by a hydraulic piston cylinder device, the end of the piston rod itself may be tapered to form the chopping knife and the piston cylinder device can be actuated by a manually triggerable valve member. A spring may be provided for resetting the knife.

BRIEF DESCRIPTION OF THE DRAWINGS

The invention will now be described by way of example, with reference to the accompanying drawings, wherein.

DETAILED DESCRIPTION OF PREFERRED EXAMPLE EMBODIMENTS AND OF THE BEST MODE OF THE INVENTION

Figure 1:
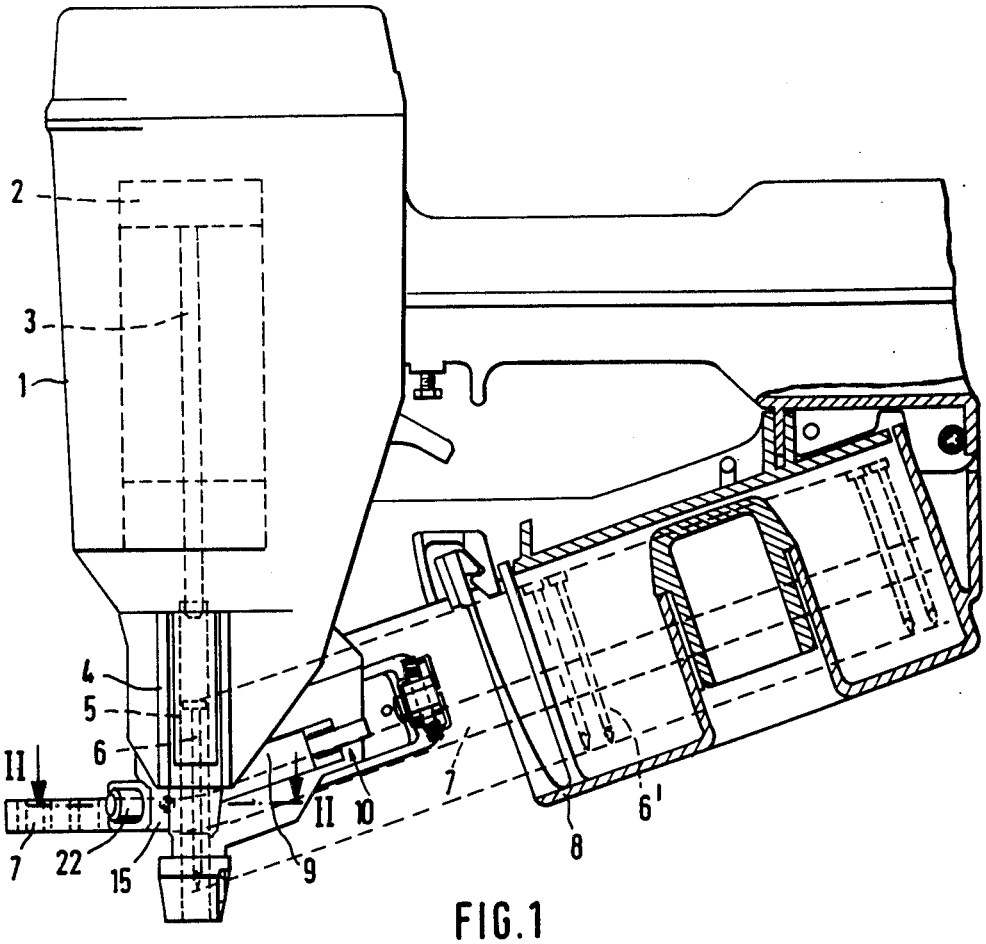
FIG. 1 is a side view of a fastener driving apparatus according to the invention, whereby part of the fastener supply magazine is shown in section.

FIG. 1 shows a fastener driving apparatus having a housing 1 with a pressure operated piston cylinder device including a piston 2 operating a driving rod 3 which is movable up and down in a cylinder foot 4 connected to the housing 1 or forming part of the housing 1 and forming a driving channel 5 through which a fastener such as a nail 6 is driven into a work piece not shown. The driving motion of the rod 3 removes the nail 6 from the supply belt 7 which forms a nail strip 6' rolled up in spiral shape inside a drum magazine 8. The output of the drum magazine 8 leads into a supply belt guide channel 9 and a feeding device 10 advances the supply belt 7 stepwise through the channel 9. Thus, when one driving operation is completed, the rod 3 is withdrawn upwardly and the next nail is moved into the driving position while the empty part of the belt 7 emerges from the belt exit slot 13 best seen in FIGS. 2 and 3.

Figure 2:
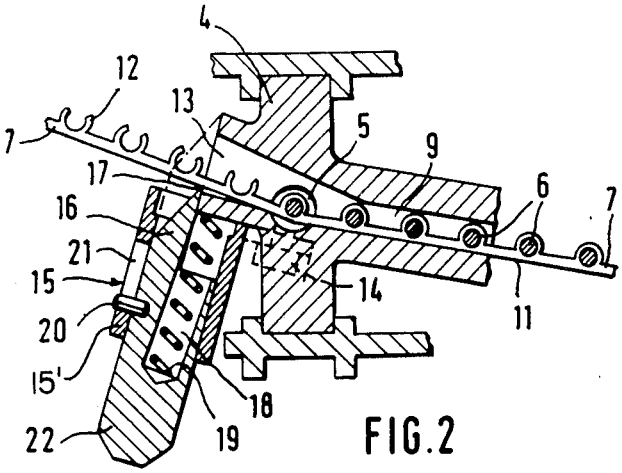
FIG. 2 is a sectional view along section line 2—2 in FIG. 1 illustrating a manual operation of the chopping knife.
Figure 3:
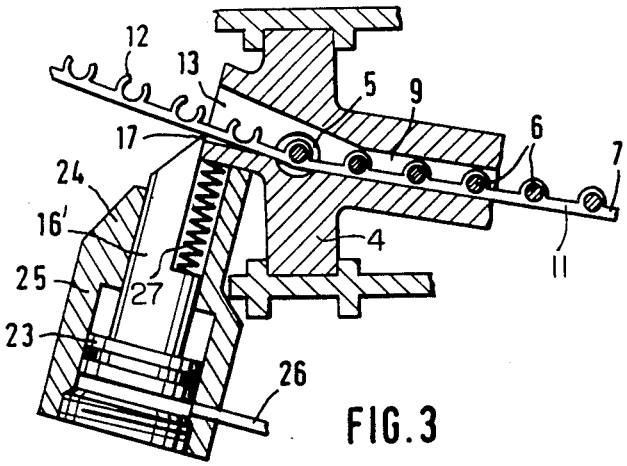
FIG. 3 is a sectional view similar to that of FIG. 2, however, showing a pneumatically operated chopping knife.

As shown in the left-hand portions of FIGS. 2 and 3 a nail 6 is torn out of the supply belt 7 by the driving operation of the rod 3 so that only the belt back 11 and the torn open holding loops 12 remain. As seen in FIG. 1, the belt back 11 has a substantially flat surface extending substantially in parallel to a longitudnal axis of the nails 6. The next driving stroke also operates conventionally the fastener feeding device 10 so that the empty portion of the belt 7 emerges stepwise out of the belt feed advance or guide channel 9.

As best seen in FIG. 2, a cutting mechanism 15 is rigidly mounted to the foot 4 by a guide bushing 15' in which a chopping knife 16 is slidable back and forth. The bushing 15' is held in place by screws 14 and in such position that the knife edge 17 is movable substantially perpendicularly to the flat surface of the back 11 of the supply belt 7. The knife 16 has an operating member 22 extending out of the guide bushing 15'. Additionally, the knife 16 is provided with a bore 18 holding a spring 19 which urges the knife 16 into the rest position shown in FIG. 2. The knife 16 cannot be pushed out of the guide bushing 15' because a stroke limiting pin 20 is stopped against an edge in a slot 21 of the bushing 15'.

In operation, the user of the driving apparatus merely needs to push the operating member 22 against any fixed surface, thereby forcing the knife edge 17 upwardly in FIG. 2 to cut off the empty portion of the belt 7. The upward movement is limited by the pin 20. Further, it is desirable that the exit slot 13 is surrounded by a flat surface which provides guiding for the knife edge 17 as the latter is moved upwardly along the slot 13.

In FIG. 3 the knife 16' forms the rod of a piston cylinder device having a piston 23 movable in a cylinder 25 provided with a guide bushing 24 for the piston rod 16' having a knife edge 17. A pressure line 26 connects the cylinder space above the piston 23 to a source of pressure not shown as a pneumatic pressure source. The pressure supply is triggered by a conventional valve not shown. A spring 27 resets the piston rod 16' just as in FIG. 2.

Although the invention has been described with reference to specific example embodiments, it will be appreciated, that it is intended, to cover all modifications and equivalents within the scope of the appended claims.

What I claim is:

1. A fastener driving apparatus, comprising a housing and means for driving fasteners held in a fastener supply belt having a surface extending substantially in parallel to a longitudinal axis of said fasteners, said supply belt passing through said housing from a belt entry to a belt exit, means for cutting an empty belt portion near said belt exit, guide bushing means for mounting said belt cutting means near said belt exit for movement of said cutting means in a belt cutting operation, said housing comprising a belt guide channel between said belt entry and said belt exit, said guide bushing means for mounting said cutting means extending substantially perpendicularly to said belt guide channel for guiding said cutting means substantially perpendicularly to said supply belt surface, whereby said supply belt is cut in a direction substantially perpendicularly to said longitudinal fastener axis.

2. The apparatus of claim 1, wherein said cutting means comprise an operating member extending out of said mounting means for manually pushing said cutting means in a direction substantially perpendicularly to said longitudinal fastener axis against a fixed body for performing a cutting operation, said apparatus further comprising spring means biasing said operating member into a position for said pushing.

3. The apparatus of claim 1, wherein said cutting means comprise piston cylinder means including a piston having a cutting edge, and means pressurizing said cylinder for performing a cutting operation.

4. The apparatus of claim 3, further comprising spring means for biasing said piston out of a cutting position.

* * * * *